US008221864B2

(12) United States Patent
Neto

(10) Patent No.: US 8,221,864 B2
(45) Date of Patent: Jul. 17, 2012

(54) TOILET PAPER ROLL HAVING ANGLED SIDES

(75) Inventor: Tsutama Satake Neto, Mogi das Cruzes-SP (BR)

(73) Assignee: Kimberly-Clark Worldwide, Inc, Neenah, WI (US)

( * ) Notice: Subject to any disclaimer, the term of this patent is extended or adjusted under 35 U.S.C. 154(b) by 330 days.

(21) Appl. No.: 12/647,729

(22) Filed: Dec. 28, 2009

(65) Prior Publication Data

US 2010/0243780 A1 Sep. 30, 2010

Related U.S. Application Data

(60) Provisional application No. 61/164,016, filed on Mar. 27, 2009.

(51) Int. Cl.
*B65H 18/28* (2006.01)
*A47K 10/16* (2006.01)

(52) U.S. Cl. ..... 428/43; 428/906

(58) Field of Classification Search ..... 428/43, 428/906; 242/160.1, 160.4
See application file for complete search history.

(56) References Cited

U.S. PATENT DOCUMENTS

| | | | |
|---|---|---|---|
| 454,316 | A | 6/1891 | Wheeler |
| 5,041,317 | A | 8/1991 | Greyvenstein |
| 5,205,454 | A | 4/1993 | Schutz |
| 5,714,210 | A | 2/1998 | Watkins |

FOREIGN PATENT DOCUMENTS

| | | | |
|---|---|---|---|
| EP | 1 529 477 | A1 | 5/2005 |
| EP | 1 929 912 | A1 | 6/2008 |
| WO | WO 93/22962 | A1 | 11/1993 |
| WO | WO 97/22288 | A1 | 6/1997 |
| WO | WO 03/026472 | A1 | 4/2003 |

*Primary Examiner* — Alexander Thomas
(74) *Attorney, Agent, or Firm* — Michael J. Sullivan

(57) ABSTRACT

Toilet paper rolls are provided with angled sidewalls that impart a wavy shape to the paper as it is unwound from the roll. When individual sheets within the roll are folded or otherwise superimposed on each other, the resulting combination provides an effective width that is greater than the actual width of the individual sheets. As a result, toilet paper sheets can be made narrower than conventional toilet paper sheets while maintaining wiping performance.

14 Claims, 2 Drawing Sheets

TOILET PAPER ROLL HAVING ANGLED SIDES

This application claims priority from presently copending U.S. Provisional Application No. 61/164,016 entitled "Toilet Paper Roll Having Angled Sides" filed on Mar. 27, 2009, in the name of Tsutama Satake Neto.

BACKGROUND OF THE INVENTION

Toilet paper or bath tissue rolls have remained relatively unchanged since first being invented in the late 1800's, essentially consisting of a length of tissue paper wound onto a cardboard core to form a roll. The length of tissue paper has spaced-apart lines of perforation that run parallel to the axis of the core (perpendicular to the machine direction of the length of tissue paper). Typically, the width of the tissue paper is about 4 inches and the distance between lines of perforation is also about 4 inches, resulting in a "sheet" measuring about 4 inches square. The individual rolls are manufactured by first producing a tissue "log", which is essentially a very long wound roll of tissue paper that is subsequently perpendicularly cut multiple times into multiple individual rolls of toilet paper using a log saw. Tissue logs can typically be about 10 feet long, for example.

In use, a toilet paper user may unwind and detach several sheets from the roll and fold them over each other to provide sufficient hand protection during wiping. In most instances, only the central portion of the combined sheets may necessarily require two or more sheets to prevent fecal matter from contacting the fingers. Having multiple sheet thicknesses around the outer edges of the combined sheets may not be necessary to provide the required hand protection, where only one sheet thickness may be sufficient in those areas. In effect, conventional toilet paper sheets can be economically inefficient in that the sheets are larger than necessary and therefore are wasteful in terms of papermaking fiber utilization.

Therefore there is a need for a toilet paper product that provides not only adequate wiping performance and hand protection, but which is also more economical in terms of fiber utilization.

SUMMARY OF THE INVENTION

It has now been discovered that a more fiber efficient toilet paper product can be produced by cutting the tissue log at an angle relative to the axis of the log instead of cutting perpendicularly. This results in a roll of toilet paper that dispenses a sheet that is wavy or sinusoidal in shape as it is unwound from the roll. When two or more sheets are overlaid or folded onto each other, the effective width of the combined sheets is greater than the actual width of the individual sheets due to the curved edges of the individual sheets. This provides two or more sheet thicknesses in the central area of the combined sheets for maximum wiping protection, yet still provides sufficient hand protection around the edges. This enables the roll of toilet paper to be narrower than a conventional roll of toilet paper, yet effectively provide the same degree of functionality and hand protection.

Hence in one aspect, the invention resides in a roll of toilet paper comprising a length of tissue paper having spaced-apart lines of perforations that define individual sheets, said roll having first and second sidewalls and a rotational axis, wherein each sidewall forms an angle with the rotational axis, wherein the angle from the rotational axis to the first sidewall is an obtuse angle from about 95 to about 135 degrees and the angle from the rotational axis to the second sidewall is an acute angle from about 45 to about 85 degrees. The two sidewalls of the roll can suitably be parallel (their angles add up to 180 degrees) or substantially parallel for manufacturing convenience, but the sidewalls can be significantly non-parallel if desired. As the obtuse angle increases and/or the acute angle decreases, the effective width of the tissue and the effective width of combining two or more individual sheets increases. By way of example, without limitation, a 3 inches wide sheet (actual width), when combined with an adjacent sheet on the roll, will provide an effective width of about 4 inches. Thus, a 3 inches wide toilet paper roll can provide essentially the same performance as a conventional 4 inches wide roll, thereby resulting in a fiber savings of about 25 percent.

The products of this invention can be made by any known tissue making process useful for making toilet paper. During the converting operations, all that is needed is to orient the log saw blades differently so that the tissue log is cut at the desired angle. There will be some waste at each end of the log due to the angled cuts, but this material can be recycled back to the tissue manufacturing process.

DETAILED DESCRIPTION OF THE DRAWINGS

The invention will be described in greater detail in connection with the Drawings. The use of like reference numbers in different figures is intended to refer to the same features.

Figure 1A:
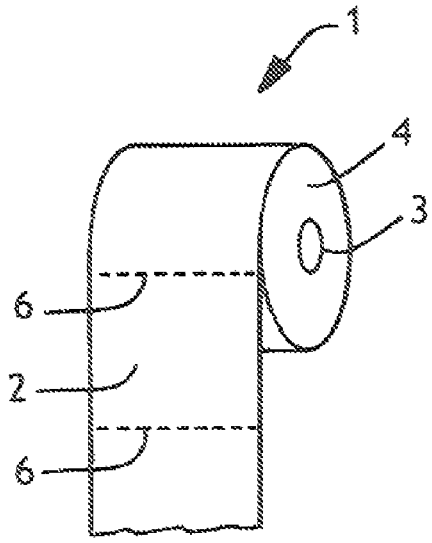
FIG. 1A (PRIOR ART)
FIG. 1A is a perspective view of a conventional roll of toilet paper.

Referring to FIG. 1A, shown is a perspective view of a conventional roll of toilet paper 1 in which a length of tissue paper 2 is wound around a cylindrical cardboard core 3. Also shown is a first sidewall 4 and spaced-apart lines of perforation 6 that define the length of the individual sheets on the roll.

Figure 1B:
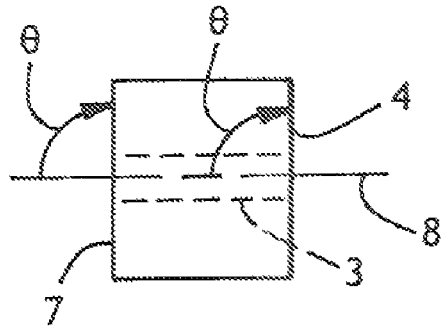
FIG. 1B (PRIOR ART)
FIG. 1B is a plan view of a conventional roll of toilet paper.

FIG. 1B is a plan view of a convention roll of toilet paper as shown in FIG. 1A. Shown is the first sidewall 4 and a second sidewall 7. The core 3 is shown in phantom lines and the rotational axis of the roll is depicted by reference number 8. As shown, the first and second sidewalls form an angle "θ" with the axis of the roll. In this case the angle "θ" is 90 degrees for both sidewalls.

Figure 2A:
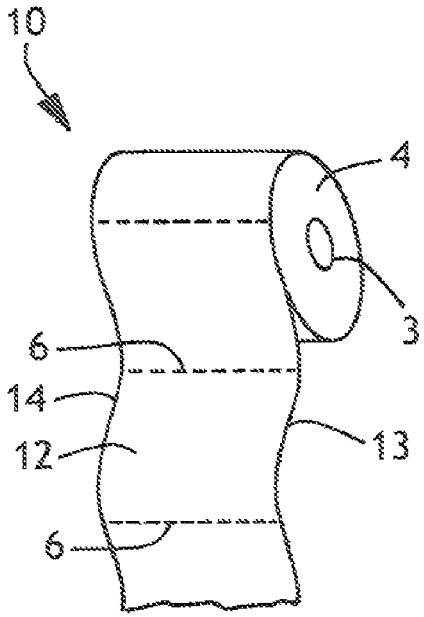
FIG. 2A is a perspective view of a roll of toilet paper in accordance with this invention.

FIG. 2A is a perspective view of a roll of toilet paper 10 in accordance with this invention. Shown is a wavy length of toilet paper 12 as it is unwound from the roll. The wavy sheet has opposing curvilinear sides 13 and 14 and contains individual sheets of toilet paper having a length defined by the distance between spaced-apart lines of perforation 6. Also shown is a first sidewall 4 and a cylindrical cardboard core 3. The toilet paper can be single-ply or multiple-ply (two-ply, three-ply or four-ply). While a cylindrical core is particularly advantageous, coreless rolls are also within the scope of this invention.

Figure 2B:
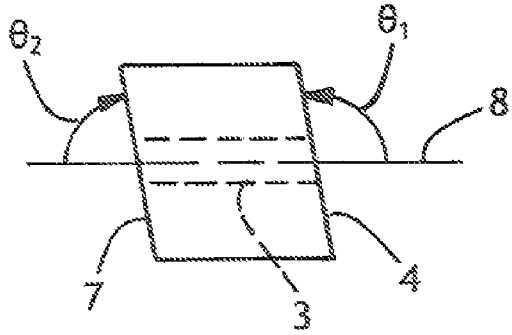
FIG. 2B is a plan view of a roll of toilet paper in accordance with this invention, illustrating the angled sidewalls.

FIG. 2B is a plan view of a roll of toilet paper in accordance with this invention as shown in FIG. 2A. Shown is the first sidewall 4, a second sidewall 7, the core 3, the rotational axis 8 and the angles $\theta_1$ and $\theta_2$ of the sidewalls relative to the rotational axis of the roll. As shown, the angle $\theta_1$ of sidewall 4 is obtuse and the angle $\theta_2$ of sidewall 7 is acute as measured from the rotational axis of the roll to the plane of the sidewall in question. For purposes herein, as shown, the angle between a sidewall and the axis of rotation is always expressed as a positive value and ignores directionality (positive or negative angle directions). In other words, an angle of −50 degrees is equivalent to an angle of +50 degrees. Since the two sidewalls are generally angled in the same direction, the angle of one side will always be acute and the angle of the other side will always be obtuse. For purposes herein, the acute angles can be from about 45 to about 85 degrees, more specifically from about 50 to about 80 degrees, more specifically from about 55 to about 75 degrees, and still more specifically from about 60 to about 70 degrees. At the same time, the obtuse angles can be from about 95 to about 135 degrees, more specifically from about 100 to about 130 degrees, more specifically from about 105 to about 125 degrees, and still more specifically from about 110 to about 120 degrees.

Figure 3A:
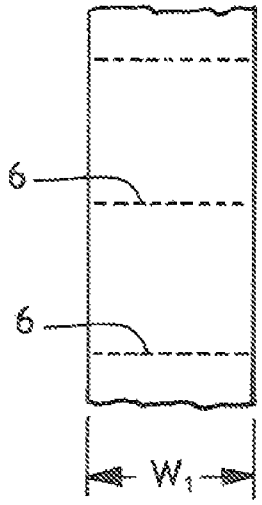
FIG. 3A (PRIOR ART)
FIG. 3A is a plan view of a length of conventional toilet paper.

FIG. 3A is a plan view of a length of conventional toilet paper having an actual width of "$W_1$". For purposes herein, width is measured from one side of a sheet to the opposite side of the sheet in a direction parallel to the rotational axis of the roll (the cross-machine direction of the tissue sheet). As shown, there are two full "sheets" separated by lines of perforations 6. The individual sheets, as previously mentioned, typically measure about 4 inches by 4 inches.

Figure 3B:
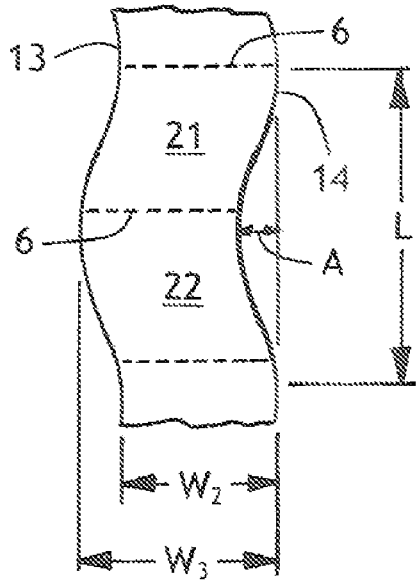
FIG. 3B is a plan view of a length of toilet paper in accordance with this invention, illustrating the wavy or sinusoidal shape of the unwound sheet.

FIG. 3B is a plan view of a length of toilet paper in accordance with this invention having a wavy or sinusoidal shape. The wave length "L", as measured from one peak to the next, represents the circumference of the roll from which the length of toilet paper is unwound. The wave length of the unwound toilet paper will gradually decrease as the roll is used up and the circumference of the roll becomes smaller. Consequently, "L" can be from about 4 or 5 inches to about 15 inches, depending upon the diameter of the core and the initial diameter of the roll. The amplitude "A" of the waves, measured as the cross-machine directional deviation from a straight line connecting consecutive wave peaks on the same side of the paper, will depend upon the angle of the sidewalls and the diameter of the roll. Without limitation, the amplitude can be from about 0.5 to about 2 inches, more specifically from about 1 to about 1.5 inches. The actual width of the toilet paper of this invention is represented by "$W_2$". The effective width "$W_3$", which is always larger than the actual width, is the cross-machine directional distance between a line connecting the peaks on one side of the paper to a line connecting the peaks on the other side of the paper as shown. Also shown are consecutive individual sheets 21 and 22 separated by cross-machine directional lines of perforation 6.

For purposes herein, the actual width of the toilet paper of this invention can be, without limitation, from about 3 to about 4 inches. The effective width can be, without limitation, from about 4 to about 6 inches.

Figure 4:
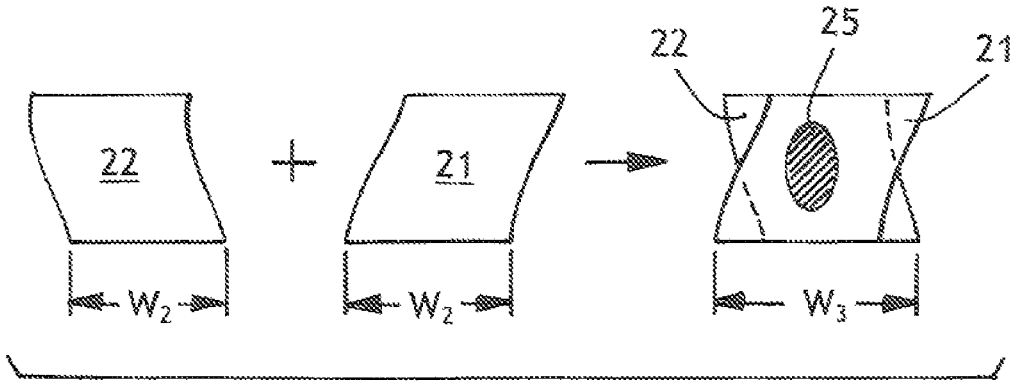
FIG. 4 is a schematic view of the combination of two consecutive sheets taken from FIG. 3B, illustrating the increase in effective width.

FIG. 4 is a schematic plan view illustrating an advantage of the product of this invention. As shown, sheet 21 from FIG. 3B is overlaid on sheet 22 from FIG. 3B. The result is a combined sheet that provides at least one layer of protection over most of the outer area, whereas the central area 25, where the most protection is required, has two layers provided by the overlapping sheets. Consequently, for example, two sheets having an actual width of 3 inches, for example, when combined, can effectively provide protection that is equivalent to the protection provided by larger sheets. The same benefit can be attained by folding a length of the toilet paper upon itself one or more times, including lengths that are longer than two sheets.

It will be appreciated that the foregoing description and figures, given for purposes of illustration, are not to be construed as limiting the scope of this invention, which is defined by the following claims and all equivalents thereto.

I claim:

1. A roll of toilet paper comprising a length of tissue paper having spaced-apart lines of perforations that define individual sheets, said roll having first and second sidewalls and a rotational axis, wherein each sidewall forms an angle with the rotational axis, wherein the angle from the rotational axis to the first sidewall is an obtuse angle from about 95 to about 135 degrees and the angle from the rotational axis to the second sidewall is an acute angle from about 45 to about 85 degrees.

2. The roll of claim 1 wherein the first and second sidewalls are parallel.

3. The roll of claim 1 wherein the obtuse angle is from about 105 to about 125 degrees and the acute angle is from 50 to about 80 degrees.

4. The roll of claim 1 wherein the obtuse angle is from about 100 to about 130 degrees.

5. The roll of claim 1 wherein the obtuse angle is from about 105 to about 125 degrees.

6. The roll of claim 1 wherein the obtuse angle is from about 110 to about 120 degrees.

7. The roll of claim 1 wherein the acute angle is from about 50 to about 80 degrees.

8. The roll of claim 1 wherein the acute angle is from about 55 to about 75 degrees.

9. The roll of claim 1 wherein the acute angle is from about 60 to about 70 degrees.

10. The roll of claim 1 wherein the paper is wrapped around a core.

11. The roll of claim 1 having an actual width from about 3 to about 4 inches.

12. The roll of claim 1 having an actual width and an effective width, wherein the effective width is greater than the actual width.

13. The roll of claim 1 wherein the length of toilet paper has a sinusoidal shape and a wavelength from about 4 to about 15 inches.

14. The roll of claim 1 wherein the length of toilet paper has a sinusoidal shape and a wavelength that decreases as the roll is unwound.

* * * * *